US005193649A

United States Patent [19]

Lee

[11] Patent Number: 5,193,649

[45] Date of Patent: Mar. 16, 1993

[54] PLATFORM CAR

[76] Inventor: Steven Lee, 11th Fl., No. 603, Sec. 5, Chungshan N. Rd., Taipei, Taiwan

[21] Appl. No.: 902,965

[22] Filed: Jun. 23, 1992

[51] Int. Cl.[5] ..... B66B 9/20

[52] U.S. Cl. ..... 187/9 R; 187/18; 254/122; 182/141

[58] Field of Search ..... 187/9 R, 9 E, 18; 254/122, 87 R, 2 R; 182/141, 63, 69; 280/47.37 R, 79.1 R

[56] References Cited

U.S. PATENT DOCUMENTS

| | | | |
|---|---|---|---|
| 4,655,466 | 4/1987 | Hanaoka | 187/18 |
| 4,690,250 | 9/1987 | Bergstrom | 187/18 |
| 5,131,501 | 7/1992 | Yoshikawa | 187/9 R |

*Primary Examiner*—Robert P. Olszewski
*Assistant Examiner*—Kenneth Noland
*Attorney, Agent, or Firm*—Woodcock Washburn Kurtz Mackiewicz & Norris

[57] ABSTRACT

A platform car includes a base frame, a platform, and two X-shaped members respectively disposed along both sides of the base frame. Each X-shaped member is comprised of a first bar having a first end pivotally attached to the base frame and a second end slidably received in an associated groove in the platform and a second bar pivotally connected to the first bar at a middle portion thereof with a first end thereof pivotally attached to the platform and a second end thereof slidably received in an associated groove in the base frame. A handle is mounted on the base frame for manually operating a piston rod of a cylinder. An actuating member is securely attached to and actuatable by the piston rod. A pair of connecting members each with a first end thereof pivotally attached to the actuating member and a second end thereof securely attached to a lower part of associated first bar of the X-shaped member. A movement of the actuating member responsive to manual operation of the handle urges the second ends of the first bars of the X-shaped members to pivot about their pivotal axes and to slide in the grooves in the platform, thereby controlling the height of the platform.

2 Claims, 3 Drawing Sheets

PLATFORM CAR

BACKGROUND OF THE INVENTION

The present invention relates to a platform car and, more particularly, to a platform car with an improved lifting structure for the platform thereof and with a hand-operable cylinder to actuate the lifting structure.

Conventional platform cars are bulky and not easy to steer. Furthermore, the structure thereof, particularly the pin for securing the piston rod of the cylinder in position, is not sound.

Therefore, there has been a long and unfulfilled need for an improved platform car to mitigate and/or obviate the above-mentioned problems.

SUMMARY OF THE INVENTION

The present invention provides a platform car including a base frame and a platform whose height can be adjusted by manual operation of a handle mounted on the base frame.

Two X-shaped members are respectively disposed along both sides of the base frame. Each X-shaped member is comprised of a first bar with a first end thereof pivotally attached to the base frame and a second end thereof slidably received in an associated groove in the platform and a second bar pivotally connected to the first bar at a middle portion thereof with a first end thereof pivotally attached to the platform and a second end thereof slidably received in an associated groove in the base frame.

Also mounted on the base frame is a cylinder to which the handle is attached for manually operating a piston rod of the cylinder. An actuating member is securely attached to and actuatable by the piston rod.

A pair of connecting members each with a first end thereof pivotally attached to the actuating member and a second end thereof securely attached to a lower part of the associated first bar of the X-shaped member. By such an arrangement, a movement of the actuating member responsive to manual operation of the handle urges the second ends of the first bars of the X-shaped members to pivot about their pivotal axes and to slide in the grooves in the platform, thereby controlling the height of the platform.

Other advantages and novel features of the invention will become more apparent from the following detailed description when taken in conjunction with the accompanying drawings.

DETAILED DESCRIPTION OF THE PREFERRED EMBODIMENTS

Figure 5:
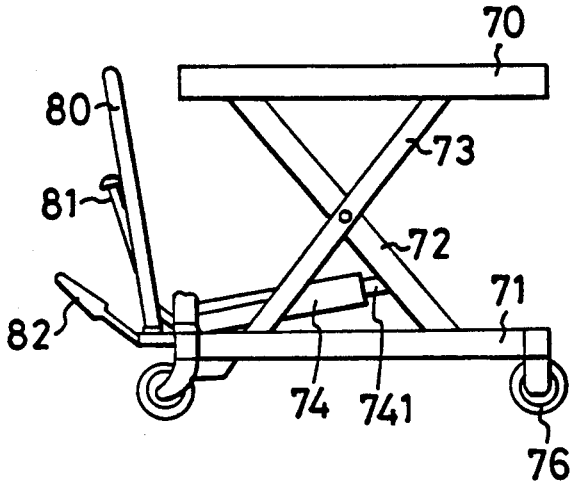
FIG. 5 PRIOR ART
FIG. 5 is a schematic side elevational view of a platform car according to prior art.
Figure 6:
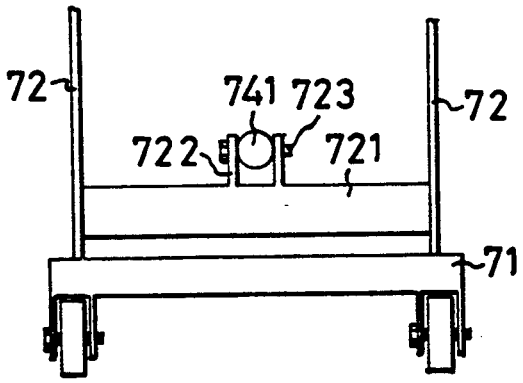
FIG. 6 PRIOR ART
FIG. 6 is a fragmentary elevational view seen from a right side of the platform in FIG. 5.

For a better understanding of the inventive background of the present invention, reference is made to FIGS. 5 and 6 in which a conventional platform car is shown. The platform includes a base frame 71 supported by casters 76, a platform 70 and a pair of X-shaped members comprised of two bars 72 and 73. A cylinder 74 with a piston rod 741 operated by a pedal means 82 is mounted on the base frame 71. Also mounted on the base frame 71 is a substantially inverted U-shaped handle 80 and a pressure-release bar 81. An upper end of bar 72 and a lower end of bar 73 are respectively slidable in associated grooves in the platform and the base frame. A lower end of bar 72 and an upper end of bar 73 are respectively pivoted to the bars frame and the platform. A link 721 is provided between the two bars 72. Two braces 722 are mounted on the link 721 for securing the piston rod 741 in position by means of a pin 723. When lifting the platform, a user operate the pedal by his or her foot, urging the piston 741 to pivot bar 72, thereby lifting the platform. For lowering the platform, a pressure-release bar 81 is provided whose function is so conventional and therefore further explanation is not required. However, such an arrangement is not easy to steer. Furthermore, the pin 723 which secures the piston rod 741 in position tends to be break easily since it is subjected to long-term shear force.

Figure 1:
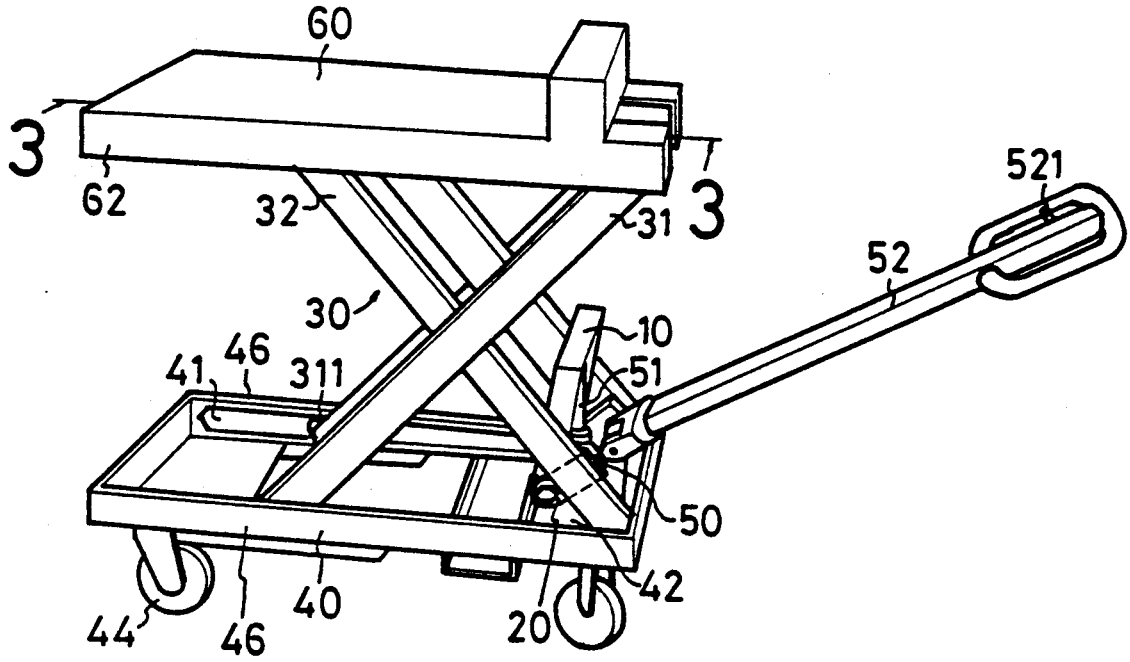
FIG. 1 is a perspective view of a platform car in accordance with the present invention.
Figure 2:
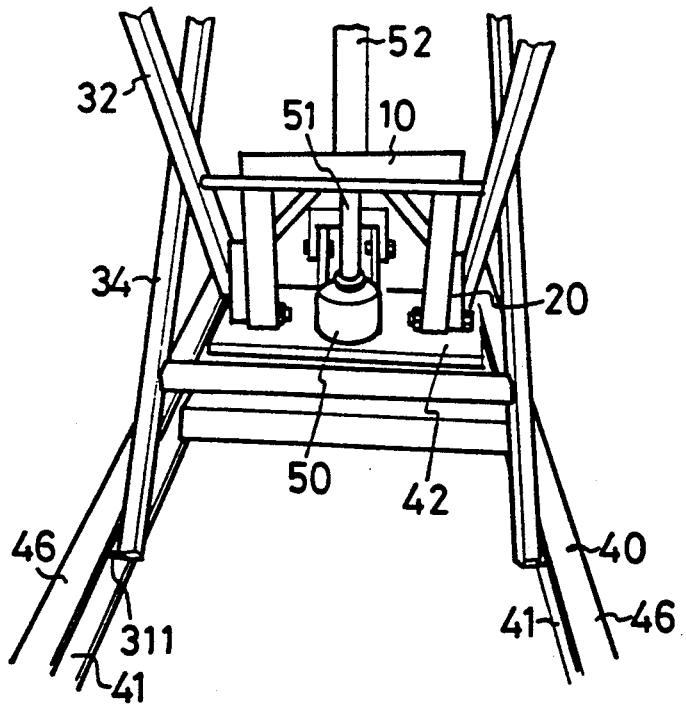
FIG. 2 is a fragmentary perspective view seen from a left side of the platform car in FIG. 1.

Referring now to FIGS. 1 and 2, a platform car in accordance with the present invention includes a base frame 40 supported by a plurality of casters 44 and a platform 60 above the base frame 40. The base frame 40 has a base plate 42 and two parallel longitudinal side plates 46 each with a first groove 41 extending along a longitudinal axis thereof. The platform 60 has two second parallel longitudinal side plates 62 each with a second groove 61 extending along a longitudinal axis thereof.

Between the base frame 40 and the platform 60 are two X-shaped members 30 respectively disposed along both sides of the base frame 40. Each X-shaped member 30 includes a first bar 32 and a second bar 34. The first bar 30 has a first end pivotally attached to the base frame 40 and a second end 321 slidably received in the second groove 61 of the platform 60. The second bar 34 is pivotally connected to the first bar 32 at a middle portion thereof with a first end thereof pivotally attached to the platform 60 and a second end 341 thereof slidably received in the first groove 41 of the base frame 40.

Also mounted on the base plate 42 is a cylinder 50 with a piston 51 to which a substantially inverted U-shaped actuating member 10 is securely attached. A handle 52 is attached to the base plate 42 at one end thereof for manually operating the cylinder 50. A pair of connecting members 20 are provided, each having a first end pivotally attached to the actuating member 10 and a second end securely attached to a lower part of associated first bar 32 of the X-shaped member 30.

Figure 3:
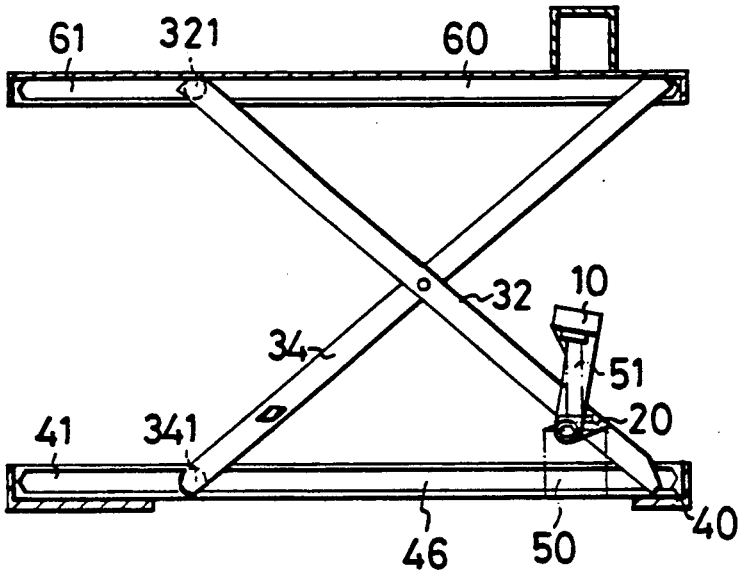
FIG. 3 is a schematic view, partly-sectioned, of the platform car in a lower position.
Figure 4:
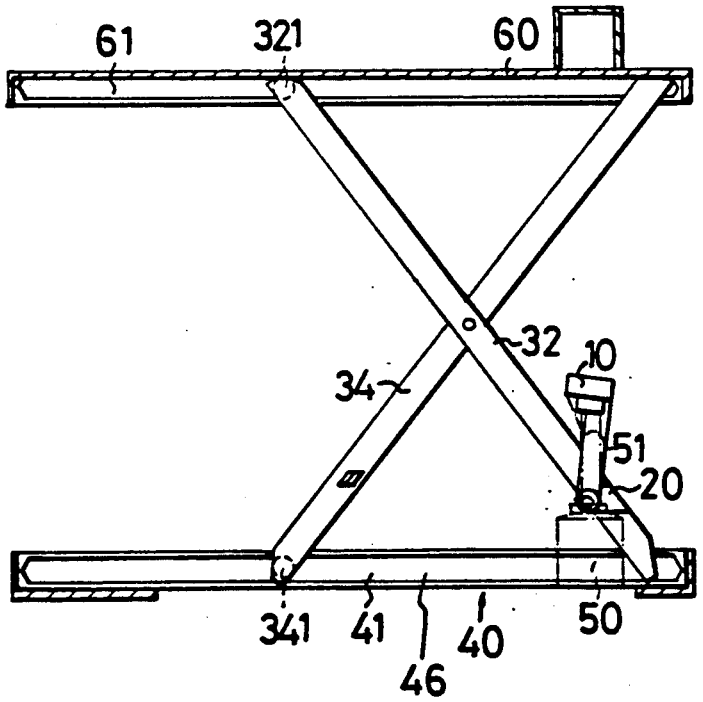
FIG. 4 is a schematic view similar to FIG. 3, in which the platform car is in a higher position.

By such an arrangement, a movement of the actuating member 1O responsive to a manual operation of the handle 52 urges the second ends 321 of the first bars 32 of the X-shaped members 30 to pivot about their pivotal axes and to slide in the grooves 61 of the platform 60, thereby controlling the height of the platform 60. Referring to FIG. 3, the platform 60 is in a lower position. When a user manually operates the handle 52 to lift the platform 60, the actuating member 10 is lifted, which causes a pivotal movement of the first end of the connecting member 20, thereby lifting the connecting member 20 and the first bar 32 to a desired position, for example, a position shown in FIG. 4. When the platform 60 needs to be lowered, a release valve 521 (see FIG. 1) is provided to achieve this purpose.

According to the above illustration, it is appreciated that the structure of the present platform car is more compact than a conventional one since the handle of the present platform car can be used as a steering device of the platform car in addition to the operation of the cylinder thereof.

Although the invention has been explained in relation to its preferred embodiment, it is to be understood that many other possible modifications and variations can be made without departing from the spirit and scope of the invention as hereinafter claimed.

I claim:

1. A platform car comprising:

a base frame with a plurality of casters, comprising two parallel longitudinal side plates each with a first groove extending along a longitudinal axis thereof; and a base plate;

a platform above said base frame, comprising two second parallel longitudinal side plates each with a second groove extending along a longitudinal axis thereof;

two X-shaped members respectively disposed along both sides of said base frame, each said X-shaped member comprising a first bar with a first end thereof pivotally attached to said base plate and a second end thereof slidably received in said second groove in said platform; and a second bar pivotally connected to said first bar at a middle portion thereof with a first end thereof pivotally attached to said platform and a second end thereof slidably received in said first groove of said base plate;

a cylinder with a piston rod mounted on said base plate;

a handle with one end thereof attached to said base plate to operate said cylinder;

an actuating member securely attached to and actuatable by said piston rod;

a pair of connecting members each with a first end thereof pivotally attached to said actuating member and a second end thereof securely attached to a lower part of associated said first bar of said X-shaped member;

whereby a movement of said actuating member responsive to a manual operation of said handle urges said second ends of said first bars of said X-shaped members to pivot about said first ends of said first bars and to slide in said grooves of said platform, thereby controlling a height of said platform.

2. The platform car as claimed in claim 1, wherein said actuating member is substantially inverted U-shaped.

* * * * *